United States Patent [19]

Ritter et al.

[11] 4,116,244

[45] Sep. 26, 1978

[54] MULTISPOT WELDING MACHINE

[75] Inventors: Josef Ritter, Graz; Alois Sackl, Liezen; Klaus Ritter; Gerhard Ritter, both of Graz, all of Austria

[73] Assignee: EVG Entwicklungs-u. Verwertungs-GmbH, Graz, Austria

[21] Appl. No.: 771,268

[22] Filed: Feb. 23, 1977

[30] Foreign Application Priority Data

Mar. 23, 1976 [AT] Austria ..... 2140/76

[51] Int. Cl.[2] ..... B21F 27/10

[52] U.S. Cl. ..... 140/112; 219/56

[58] Field of Search ..... 140/3 R, 9, 102, 112; 29/452; 219/56, 58

[56] References Cited

U.S. PATENT DOCUMENTS 2,077,061 4/1937 White ..... 140/112

FOREIGN PATENT DOCUMENTS 1,594,718 7/1970 France ..... 140/9

*Primary Examiner*—Lowell A. Larson

*Attorney, Agent, or Firm*—Ernest F. Marmorek

[57] ABSTRACT

A multispot welding machine for producing a mesh web from arrays of wire running skew to the longitudinal direction of the web and crossing one another has two endless synchronously circulating feeders which carry deflector-pins and each of which has a straight working run; the runs are uniformly spaced from one another and each defining a different one of the edges of the mesh web to be produced, a wire-layer which is movable to and fro across the feeders and arranged to lay perpendicular to the runs a number of wires alternately about a corresponding number of deflector-pins on the working runs of the two feeders, and a welding zone having means for welding the wires together at their crossover points. The wire-layer has an auxiliary drive mechanism which is capable of imparting to the wire-layer, each time after the wire-layer crosses over the working run of a feeder, an additional rapid forwards motion in a direction parallel to the working runs and subsequent backwards motion so as to form loops of the wire around the deflector-pins.

6 Claims, 8 Drawing Figures

MULTISPOT WELDING MACHINE

BACKGROUND OF THE INVENTION

The invention refers to a multispot welding machine for producing a mesh web from arrays of wires running skew to the longitudinal direction of the web and crossing one another, the machine having two endless circulating feeders, such as belts or chains, which carry deflector-pins and each of which has a working run defining a different one of the edges of the mesh web to be produced, a wire-layer which is movable to and fro across the feeders and arranged to lay a number of wires alternately about a corresponding number of deflector-pins on the working runs of the two feeders, and a welding zone having means for welding the wires together at their crossover points. Such a machine is hereinafter referred to as if the kind described.

The meshes produced by such a machine have rhombic or square mesh apertures the diagonals of which run in directions longitudinal and transverse to the grid web, for which reason these meshes are also called "diagonal meshes"

A multispot welding machine of this kind having endless feed-chains which describe orbits lying perpendicular to the place of production of the mesh, and deflector-pins in the form of parts with hooked ends, which lie in a plane parallel with the orbital plane of the feed-chains, is known from the U.S. Pat. No. 1,922,270. An improved form of multispot welding machines in which the orbits of the endless feed chains or belts lie in a common plane running parallel with the plane of production of the mesh and the deflector-pins project from this place at least approximately perpendicularly, forms the subject of our copending application which corresponds to Austrian patent application No. A1326/76 of Feb. 24, 1976.

Usually with these machines the wires at both edges of the mesh web to be produced are laid round the deflector-pins in such a way that the apertures of the mesh at the edges of the web have cuter corners rounded off according to the radius of the pins. It has now been appreciated that, in some cases, it would be desirable to produce mesh webs in which the edges are provided with earlike loops of wire. Through such wire loops, e.g., in the production of fences, supporting wires for the mesh might advantageously be threaded.

SUMMARY OF THE INVENTION

In accordance with the invention, in a machine of the kind described, the wire-layer has a drive mechanism which is capable of imparting to the wire layer, each time the wire layer crosses over a working run of a feeder, an additional rapid forward motion and subsequent backward motion so as to form loops of the wire around the deflector-pins.

Limit-switches may be provided which, each time upon arrival of the wire-layer at the desired starting point for the additional motion in the forward or backward direction respectively, deliver control impulses for the drive mechanism which effect the additional motion of the wire-layer, e.g., for solenoid valves of pneumatic or other fluid pressure operated cylinders. For this purpose adjustable switch-actuating members may be provided on the wire-layer. Besides this, adjustable stops may be advantageously provided for limiting the motion of the wire-layer in the longitudinal direction of the mesh web.

The drive mechanism for the wire-layer, which is used for the formation of the wire loops, may be disconnectable from the other drive mechanisms of the wire layer so that at option mesh webs may be produced by the machine either with wire loops at the edges or without such loops.

BRIEF DESCRIPTION OF THE DRAWINGS

An example of a machine constructed in accordance with the invention and comprising an improvement of that described in copending application corresponding to Austrian application No. A1326/76, illustrated in the accompanying drawings, in which.

FIGS. *7a* and *7b* show meshes respectively with and without wire loops at the edges, which can be produced at option by the machine.

DESCRIPTION OF THE PREFERRED EMBODIMENTS

Figure 2:
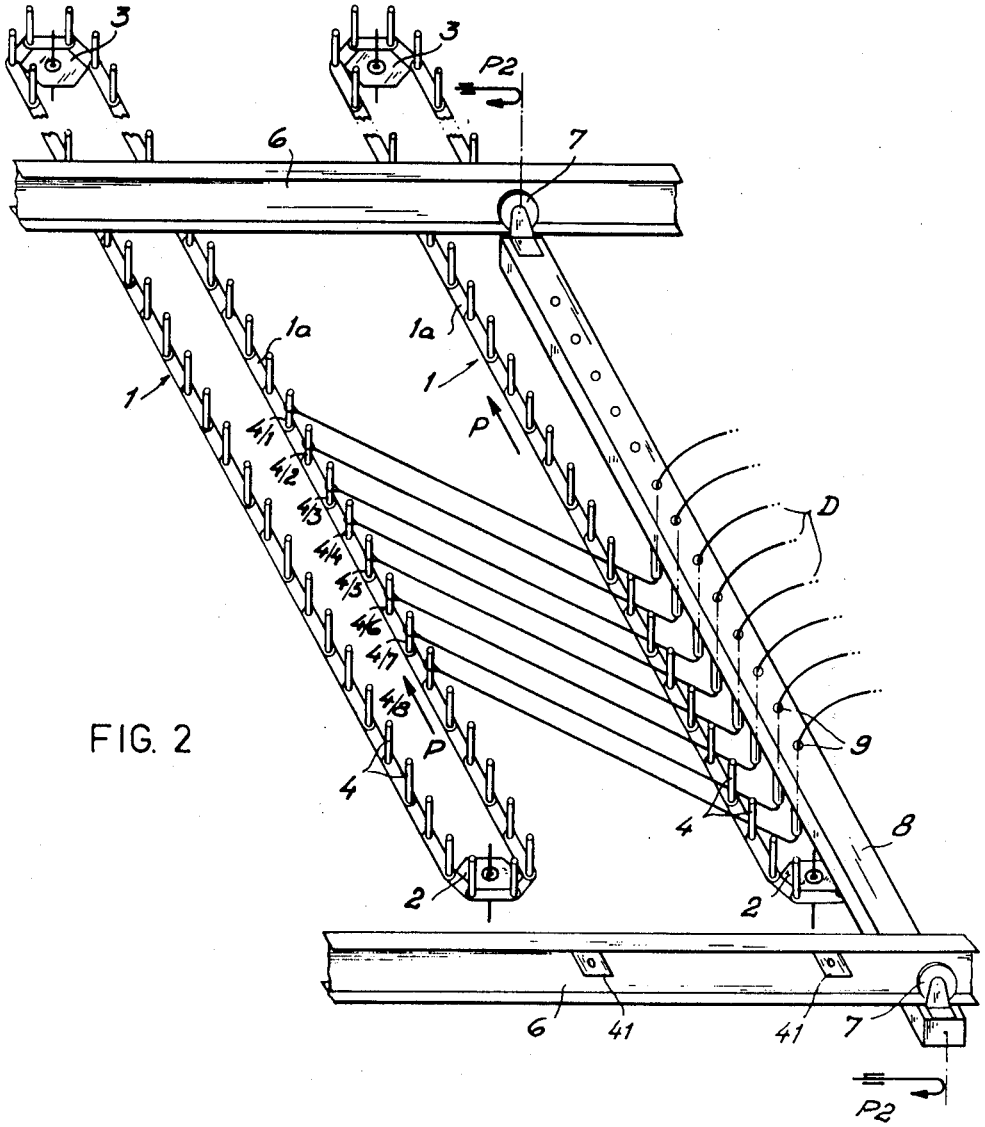
Figure 3:
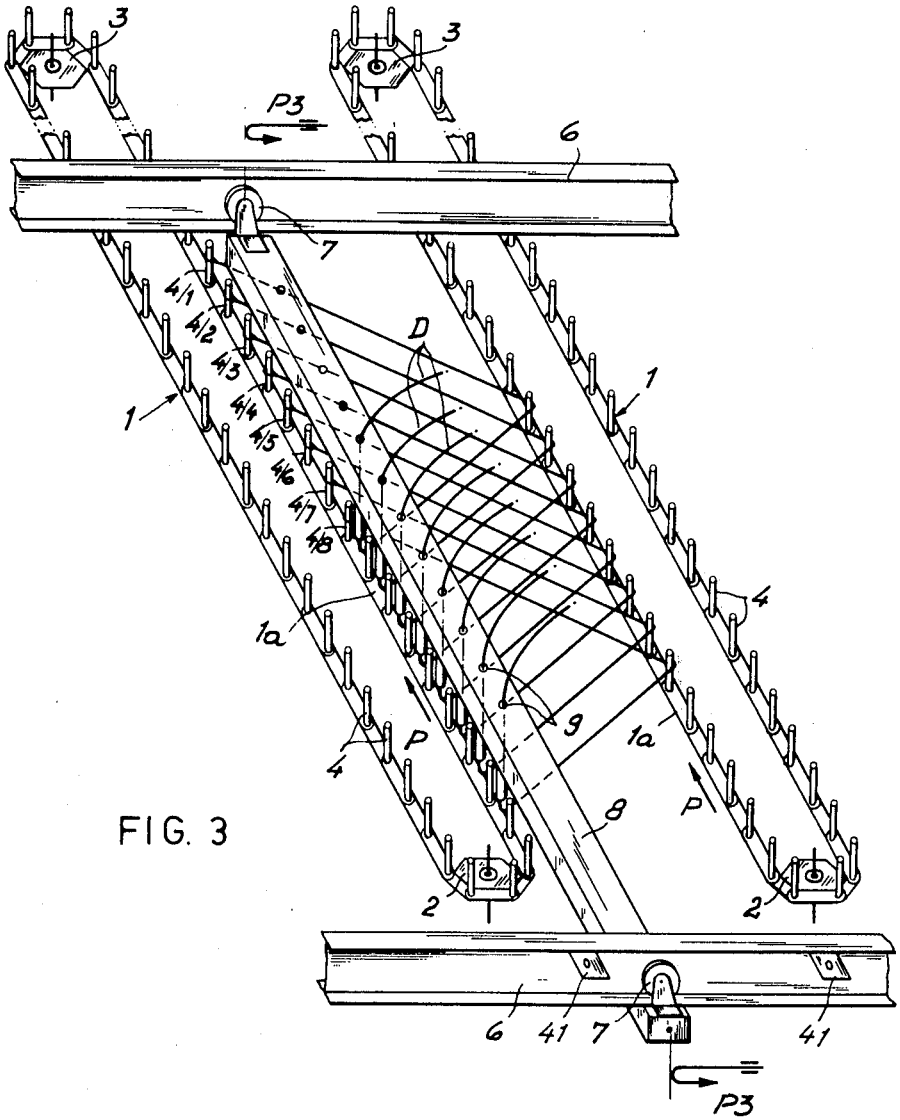
Figure 4:
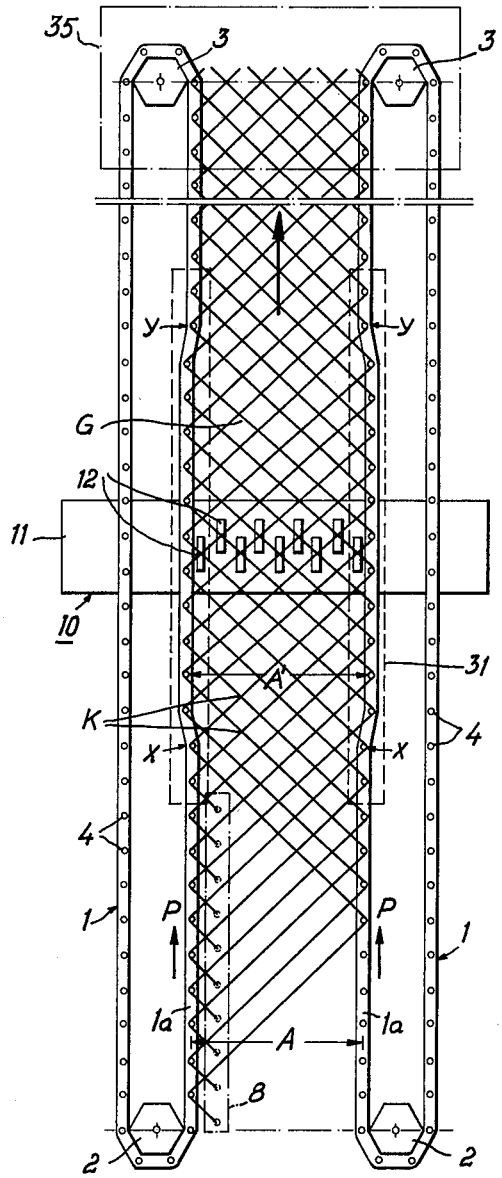
FIG. 4 shows a diagrammatic plan view of the machine with the wire-layer and the upper welding electrodes omitted.

As may be understood from FIGS. 1 to 4 in accordance with the earlier Application already mentioned endless feeder chains 1 are arranged at the two sides of the welding machine, the orbits of which lie in a common plane which runs parallel with the plane of production of the mesh which in FIG. 4 is parallel with the plane of the drawing. Each chain is looped round two sprockets 2, 3, one at least of which is driven. The chain wheels 2, 3 are supported firmly in a machine frame which is not shown.

From the feed-chains 1, perpendicular to their orbital plane, deflector-pins 4 project upwards, the mutual separation *a* of which corresponds with a diagonal of one aperture of the wire mesh to be produced. The working runs 1*a* of both feed-chains 1 run parallel with one another and are moved together in the direction of the arrow P. The mutual separation A of the rows of deflector-pins 4 carried by the inner or working runs 1*a* of the chains correspond with the width of the mesh web G to be produced.

On two bearer rails 6 running across the machine a wire-layer 8 is arranged to be able to travel in the transverse direction perpendicular to the working runs 1*a* by means, e.g., of rollers 7. This wire-layer has the form of a beam in which is formed a row of guide-eyes 9 which have the same mutual separation *a* as the deflector-pins 4 on the feeder chains 1. The wire-layer, by driving means (not shown) synchronized with the drive of the feeder chains 1, is set in motion to and fro substantially at right angles to the runs 1*a* at such a speed that from a starting position at the lefthand feeder chain run 1*a* in FIG. 1, after the to-and-fro motion across the machine it returns to the starting position again just at the instant at which the run 1*a* of chain has moved onwards by a number of pin-pitches *a* which corresponds with the number of wires laid by the wire-layer.

Figure 1:
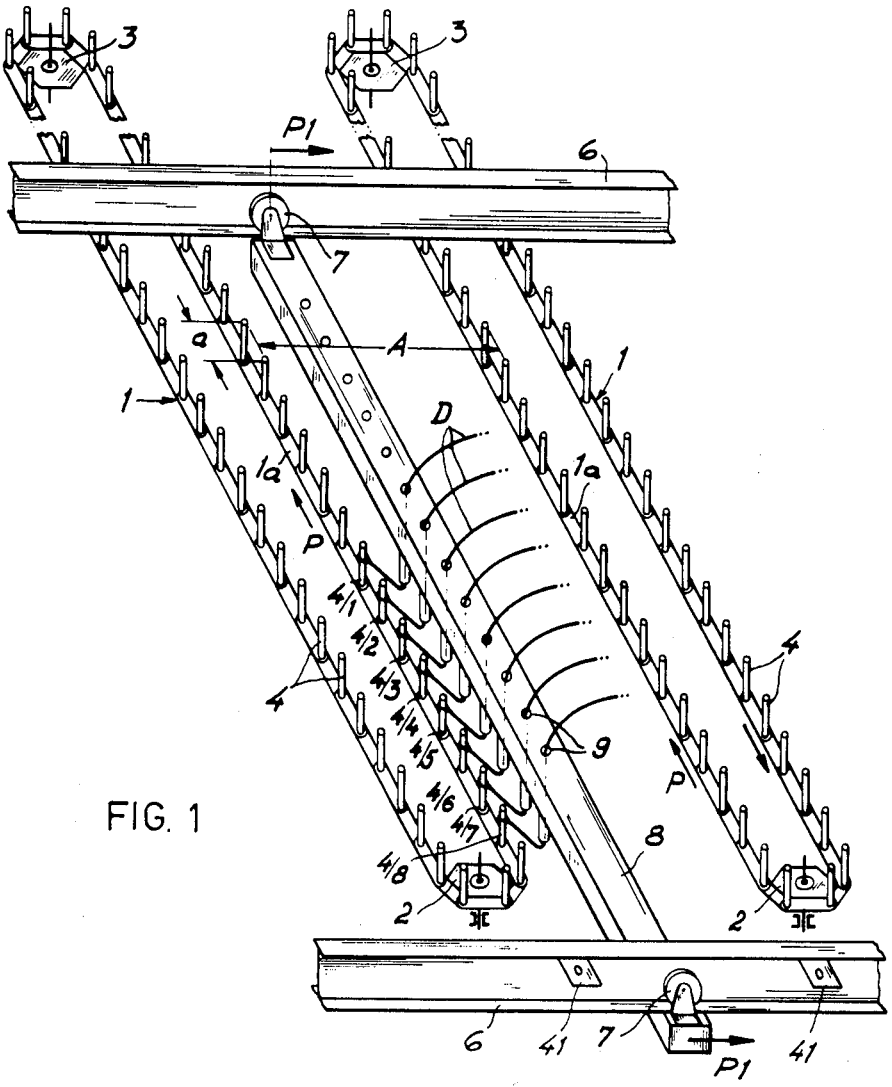
FIGS. 1 to 3 show in three different phases of operation illustrated axonometrically in plan the cooperation of the wire-layer with the feeder chains and deflector-pins of the machine.

The wires D are drawn off stock reels, passed through the guide-eyes 9 in the wire-layer 8 and at the start of production of a mesh web fastened by their ends in accordance with FIG. 1 to a corresponding number of deflector-pins 4. In the example as FIGS. 1 to 3 wires D have been passed through eight guide-eyes 9 in the wire-layer 8 and fastened by their ends to eight successive deflector-pins 4 which are designated in FIG. 1 by 4/1 to 4/8.

After the starting phase of the production of a mesh web as shown in FIG. 1, the wire-layer 8 by transverse displacement in the direction of the arrow P1 arrives in the position shown in FIG. 2, on the far side of the working run 1*a* of the righthand feeder chain 1, whilst at the same time the deflector pins 4/1 to 4/8 securing the ends of the wires on the left-hand feeder chain advance in the direction of feed by the distance 4*a*. In the case of the production of ordinary mesh webs as in FIG. 7*b*, i.e., those without loops in the wires at the web edges, the wire-layer 8 in the phase of operation as FIG. 2 reverses its direction of motion in accordance with the arrow P2, so that the wires get looped round deflector-pins 4 on the inner strand of the right-hand feeder chain and led back to the inner run of the lefthand feeder chain are at an angle to the sections of wire which have just been laid, as shown in FIG. 3, in order after a total advance of this run of chain by the distance 8*a*, to be looped in a similar manner by a movement of the wire-layer 8 in the direction of the arrow P3, round the next eight deflector-pins 4 on this run of chain.

The cross-over points K of the wires in the mesh web G resulting from this, upon passing through the welding zone 10 which may be understood from FIG. 4, are welded in known manner by electrical resistance welding, e.g., by means of roller electrodes 12 on the one side of the plane of production of the mesh and panel-like counter-electrodes 11 on the other side of it.

In order to stretch the wires D in the welding zone, which have been laid by the wire-layer 8 loosely round the deflector-pins 4 on the strands 1*a* of the two feeder chains 1, and thus to bring them exactly into the correct position for welding, by means not shown the inner strands 1*a* of the two feeder chains 1 are in accordance with FIG. 4 deflected locally outwards in the course of their motion of advance between the points X and Y, so that the normal separation A of the rows of deflector-pins 4 which are carried by the runs of the chains and which define the width of the mesh Web G is increased in the welding zone to the value A'.

Thus far the machine illustrated corresponds with that in the eariler application already mentioned. In order to be able with the same machine to poduce also meshes in accordance with FIG. 7*a*, i.e., those loops at the edges, an additional drive mechanism is provided for the wire-layer 8 as shown in FIG. 5.

Figure 5:
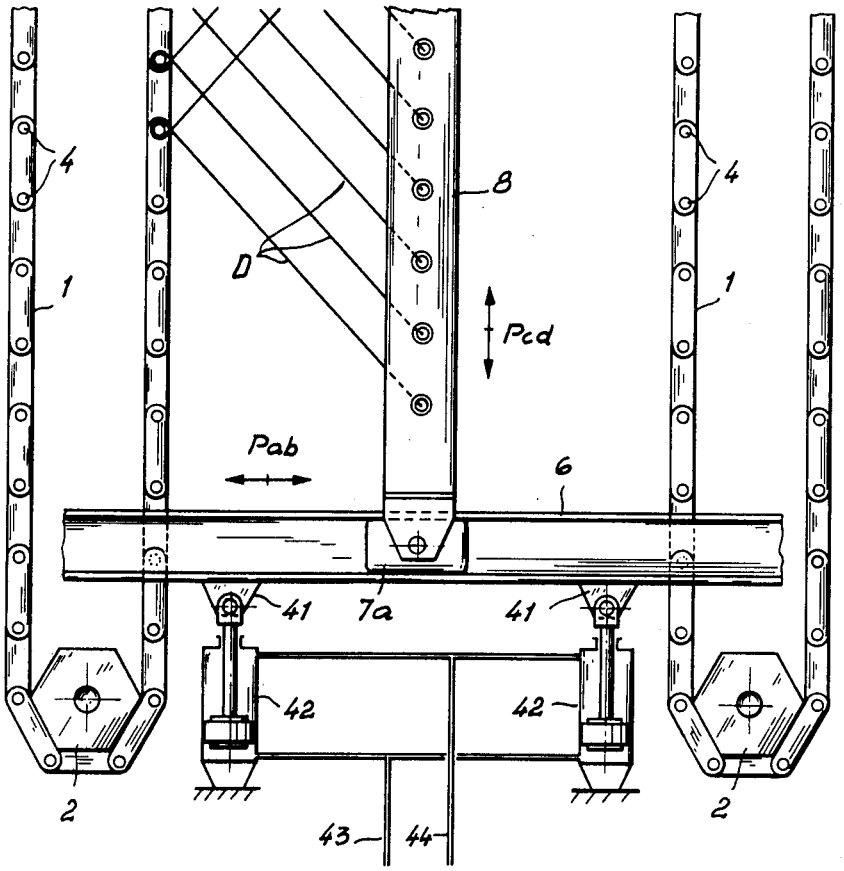
FIG. 5 illustrates diagrammatically the additional drive mechanism for the wire-layer used for formation of loops.

As FIG. 5 shows, the wire-layer 8 which is guided by means of a slider, 7*a* (or in accordance with FIG. 1, by means of rollers 7) so as to be able to be displaced along the bearer rails 6 in the direction of the double arrow P*ab* transversely to the mesh web to be produced, is in addition movable to and fro in the direction of the double arrow P*cd* in the direction longitudinal to the mesh web, because the two bearer rails 6 are combined into a rigid frame, which carries lugs 41 with which the piston rods of pistons in double-acting operating-cylinders 42 engage. The lugs 41 are also shown in FIGS. 1 to 3. The operating cyclinders 42 may be acted upon by a pneumatic or other pressure medium at option on the one or other side of their cylinders via solenoid valves (not shown) and pipes 43, 44.

Figure 6:
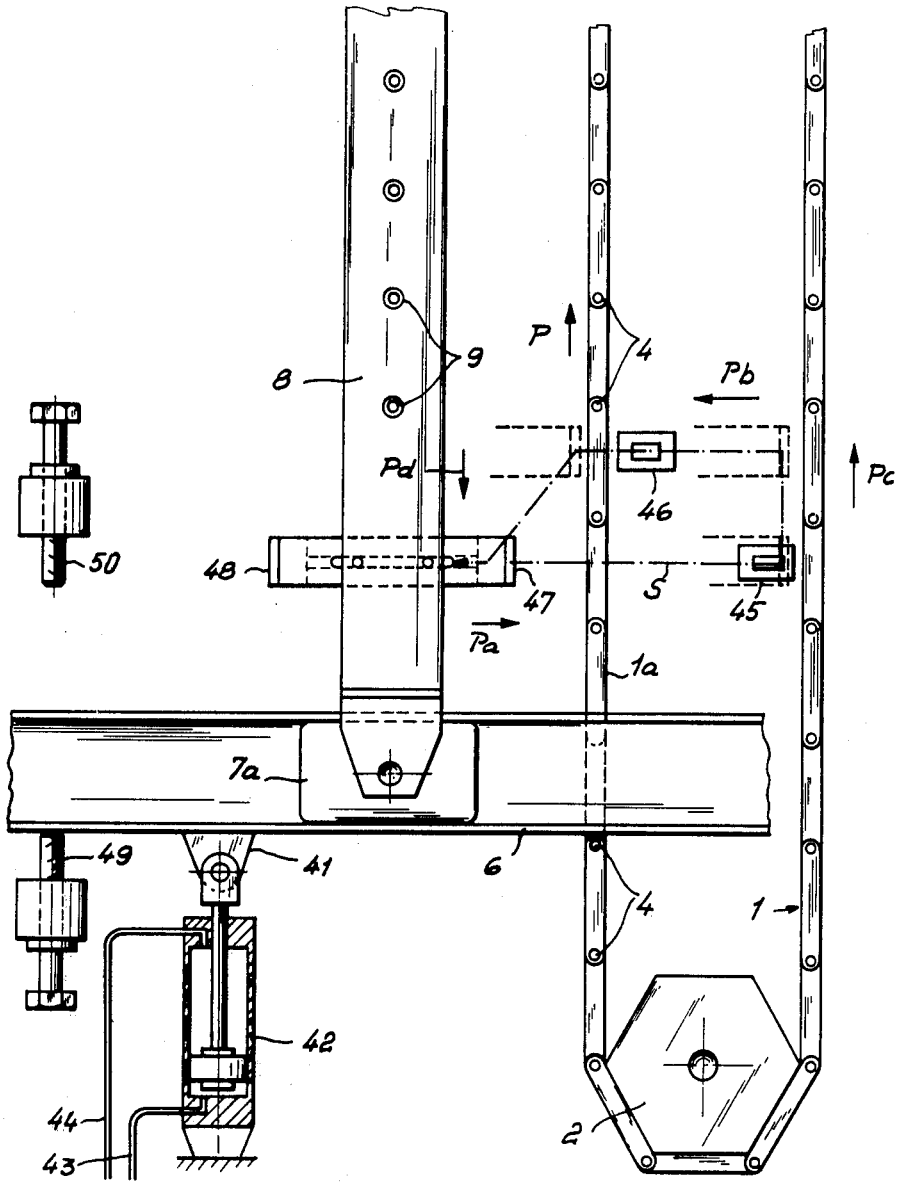
FIG. 6 shows details of this drive mechanism on a larger scale.

The control impulses for the solenoid valves are, in accordance with FIG. 6, delivered on each side of the machine by limit-switches 45, 46 which are arranged offset from one another in the directions longitudinal and transverse to the mesh web in such a way that in the limiting position of the bearer rail 6 as shown, which is established by an adjustable stop 49, a switch-actuating member 47 fastened to the wire-layer 8, upon movement of the wire-layer in the direction of the arrow P*a* towards the right and after crossing over the inner run 1*a* of the feeder chain 1 nearly to the point of reversal of the transverse motion of the wire-layer, actuates the switch 45, and thereby via an associated solenoid valve effects a feed of pressure medium to the pipe 43. The wire-layer 8 by means of the frame formed of the bearer rails 6 is then moved by pistons in the operating cylinders 42, in FIG. 6 in the direction of the arrow P*c*, rapidly upwards into the other limiting position established by an adjustable stop 50, in which the switch-actuating member 47 lines up in the direction transverse to the web with the limit-switch 46. The motion of the wire-layer 8 in the direction of the arrow P*c* occurs more rapidly than the motion in the same direction of the run 1*a* of the feed chain 1 and of the deflector-pin fastened to it.

Figure 7A:
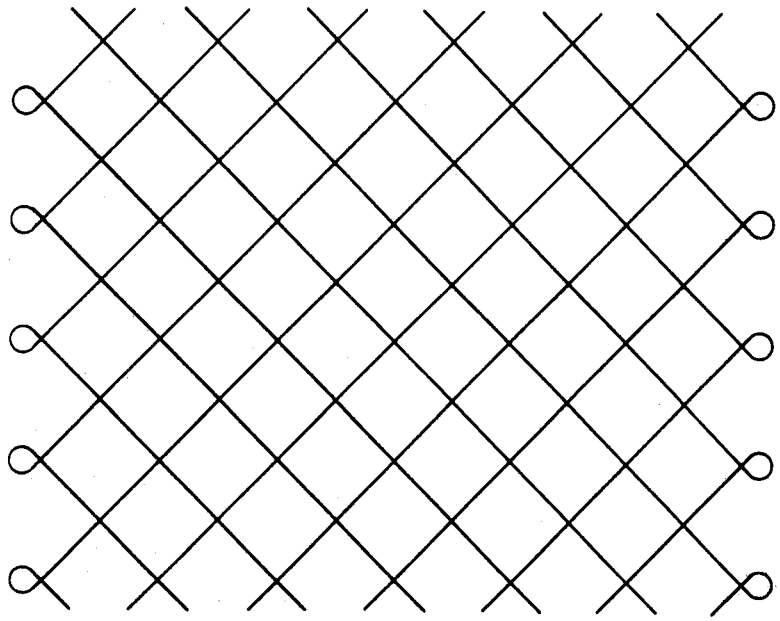

Upon the ensuing return transverse motion of the wire-layer 8 in the direction of the arrow P*b* the limit-switch 46 is actuated by the actuating-member 47, whereby via solenoid valves, instead of the pipe 43 the pipe 44 is now acted upon by pressure medium, and the wire-layer 8 then in FIG. 6 is moved by a compound motion in the direction of the arrows P*b* and P*d* to the left and at the same time downwards. The relationship between the motions is moreover so determined that the actuating-member 47 performs the loop-motion S indicated in FIG. 6 by a dash-dot line and all the guide-eyes 9 in the wire-layer make this loop-motion with it in such a way that they thereby encircle an associated deflector-pin 4 on the inner run 1*a* of the feed-chain 1, which FIG. 6 is moving upwards in the direction of the arrow P, so that the wires D get looped round the deflector-pins 4 on this run 1*a* in the form of loops. A second-switch actuating member 48 in a similar manner via limit-switches controls the sequence of motions on the other side of the mesh web, so that a mesh according to FIG. 7*a* is obtained.

Figure 7B:
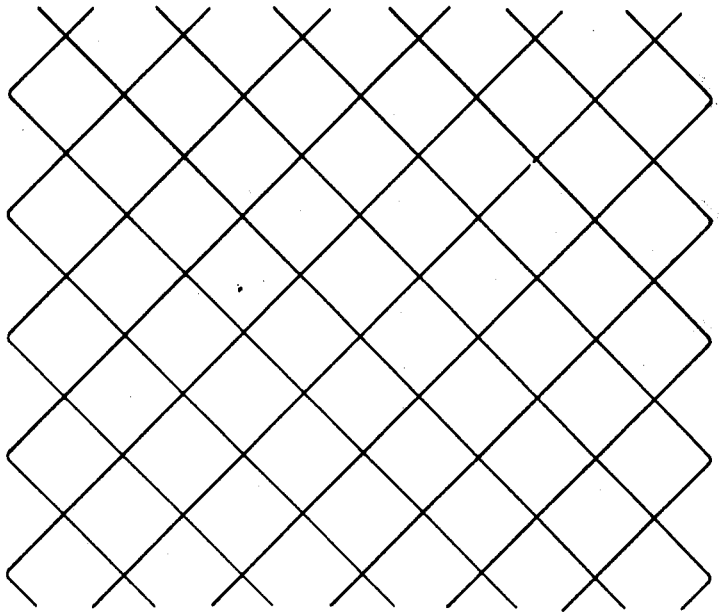

If the operating cylinders 42 are shut down, for example by switching off the pressure medium circuit by means of gate valves (not shown), or by switching off the current circuit to the limit-switches 45, 46, on the same machine a mesh without edge-loops as illustrated in FIG. 7*b* can also be produced.

Since the finished mesh web, because of the deflector-pins projecting into the mesh cannot be withdrawn from the two feed-chains in the direction of feed, a driven reeler roll 35 is advantageously provided above the plane of production of the mesh as indicated in FIG. 4, which pulls the finished mesh upwards off the deflector-pins. We wish it to be understood that we do not desire to be limited to the exact details of construction shown and described, for obvious modifications will occur to a person skilled in the art.

Having thus described the invention, what we claim as new and desire to be secured by Letters Patent, is as follows.

What is claimed is:

1. In a multispot welding machine for producing a mesh web from arrays of wires running skew to the longitudinal direction of said web and crossing one another, said machine being of the kind having two endless synchronizing circulating feeders which carry deflector-pins and each of which has a straight working run, said working runs being uniformly spaced from one another and each defining a different one of the edges of said mesh web to be produced, a wire layer which is movable to and fro across said working runs and is arranged to lay at substantially right angles to said working runs a member of wires alternatively about a corresponding number of deflector-pins on said working runs and a welding zone having means for welding said wires together at the crossover points thereof; the improvement which comprises an auxiliary drive mechanism for said wire-layer, said drive mechanism being adapted of imparting to said wire-layer, each time after said wire-layer crosses over one of said feeder working runs, an additional rapid forward motion and a subsequent backward motion in a direction parallel to said working runs, whereby loops of wire are laid around said deflector-pins.

2. A machine according to claim 1, wherein said drive mechanism includes fluid pressure operated cylinders for providing said forwards and backwards motion.

3. A machine according to claim 1, further comprising limit switches adapted to be operated and produce signals each time upon arrival of said wire-layer at the desired starting point for said additional motion in the forwards or backwards direction, said drive mechanism responding to said signals.

4. A machine according to claim 3, wherein adjustable switch actuating members are provided on said wire-layer for actuating said limit switches.

5. A machine according to claim 1, wherein adjustable stops are provided for limiting said additional motion of said wire-layer in the longitudinal direction of said mesh web.

6. A machine according to claim 1, wherein means are provided for disconnecting said loop forming drive mechanism for said wire-layer whereby selectively mesh web may be produced without said loops.

* * * * *